United States Patent [19]

Minner

[11] 4,452,220

[45] Jun. 5, 1984

[54] ELECTRONICALLY CONTROLLED IGNITION SYSTEM

[75] Inventor: Willy Minner, Schwaigern, Fed. Rep. of Germany

[73] Assignee: Telefunken Electronic GmbH, Heilbronn, Fed. Rep. of Germany

[21] Appl. No.: 397,404

[22] Filed: Jul. 12, 1982

[30] Foreign Application Priority Data

Jul. 15, 1981 [DE] Fed. Rep. of Germany ..... 3127230

[51] Int. Cl.[3] ..... F02P 1/00

[52] U.S. Cl. ..... 123/644; 123/630; 123/609; 123/335

[58] Field of Search ..... 123/609, 644, 630, 335

[56] References Cited

U.S. PATENT DOCUMENTS

| | | | |
|---|---|---|---|
| 3,601,103 | 8/1971 | Swiden | 123/335 |
| 3,738,340 | 6/1973 | Olson | 123/335 |
| 3,884,203 | 4/1975 | Cliffgard | 123/335 |
| 4,082,075 | 4/1978 | Davis | 123/609 |
| 4,173,962 | 1/1978 | Rabus et al. | 123/644 |

*Primary Examiner*—Ronald B. Cox

*Attorney, Agent, or Firm*—Spencer & Frank

[57] ABSTRACT

An ignition system has an electronic control unit which produces trigger pulses in response to received ignition control signals, the control unit also receiving test pulses indicating the period of time for which current supplied to the primary winding of the ignition coil is at its maximum value, the control unit extending the test pulses and supplying the extended pulses to a logic circuit which, when a trigger pulse occurs without an extended pulse simultaneously occurring, produces an output signal to indicate misfiring, and to temporarily switch off the control.

5 Claims, 7 Drawing Figures

U_IN
H
0
P1
P2
P3
P4

U TRIGGER
E2
tx

Ipr
I pr max

Ute
te
ZA

U INTEGR
E1
ty

UMF

ELECTRONICALLY CONTROLLED IGNITION SYSTEM

BACKGROUND OF THE INVENTION

The invention relates to an electronically controlled ignition system. In one such system, the timing of the supply of the primary current ($1_{pr}$) flowing through the primary winding of the ignition coil is controlled in accordance with the speed so that the said current only reaches the value ($I_{prmax}$) required for ignition shortly before the time of ignition. It is established immediately before the moment of ignition whether the primary current has reached the value required for ignition by deriving a test pulse ($U_{te}$) from the duration ($t_e$) of the primary current at the value ($I_{prmax}$) required for ignition, said test pulse being used to disconnect the electronic control unit for a fixed period of time when there is no primary current or insufficient primary current to prevent misfiring. The timing of the supply of the primary current is derived directly from the control signal ($U_{IN}$) of the ignition pulse generator and once the period of disconnection has been completed the electronically controlled regulating condition is again implemented continuously and automatically.

An electronically controlled ignition system of this type is described in German Patent Application No. P31 11 856.9. In the previously proposed controlled ignition system, a test pulse having duration $t_e$ is obtained from the duration of the primary current at its value necessary for ignition. This test pulse actuates a switch by means of which a capacitor is discharged, said capacitor being charged when there are no $t_e$ pulses. From this there is the result that the voltage drops across the capacitor when test pulses are lower than the value of a comparison voltage which is fixed and pre-determined and is for example half as high as the maximum voltage possible at the capacitor during the following test pulse. This comparison voltage is compared by a comparator with the capacitor voltage, a signal only occurring at the output of the comparator when the capacitor voltage is higher than the comparison voltage during a particular trigger pulse. This can only be the case when there is no test pulse immediately preceding the respective trigger pulse and therefore sufficient discharge of the capacitor is not ensured. However if there is no test pulse this is the same as misfiring, since in this case the primary current through the ignition coil has not yet reached the value required for ignition. The trigger pulse activating the comparator is obtained from the negative disconnection flank or trailing flank of the control signal when this control signal of the ignition pulse sensor passes from its high level to its low level. For example, a mono-stable trigger stage changes from its stable condition to its quasi-stable condition by an output signal at the comparator, so that during the period when the said mono-stable trigger stage is in its quasi-stable condition, the electronic control unit is disconnected and the timing of the supply of the primary current through the ignition coil is derived directly from the control signal from the ignition pulse generator. If the period of disconnection is at an end then the electronically controlled regulating condition is again implemented continuously and automatically in the manner described in the above mentioned patent application.

SUMMARY OF THE INVENTION

The present invention seeks to improve the known circuit further and in particular to provide a circuit which contains small capacitors which can be integrated. According to a first aspect the invention provides an electronic control unit for an electronically controlled ignition system having an ignition coil with a primary winding, comprising means for producing a control signal for controlling the supply of primary current pulses to said primary winding, means for deriving trigger pulses from said control signal, means for producing test pulses dependent on the period of time for which said primary current pulses are at a predetermined value, an integrating stage, said integrating stage extending said test pulses by a predetermined period of time to produce extended pulses, and logic means having first and second inputs, said first input receiving said extended pulses and said second input receiving said trigger pulses, said logic means producing an output signal if it does not receive an extended pulse during a trigger pulse.

According to a second aspect the invention provides an electronically controlled ignition system comprising an ignition coil having a primary winding, means for supplying primary current to said primary winding at a timing which is controlled in accordance with speed, said primary current only reaching the value required for ignition shortly before the moment of ignition, means for determining immediately before the moment of ignition whether said primary current has reached said value required for ignition, said determining means comprising means for deriving a test pulse dependent on the duration for which said primary current is at said value required for ignition, said test pulse switching off the electronic control for a fixed period when there is no primary current or insufficient primary current to prevent misfiring, and an ignition pulse generator producing a control signal the timing of said primary current being derived directly from said control signal, wherein the system further comprises an integrating stage, said integrating stage extending said test pulse by a predetermined period of time to produce an extended pulse, a logic circuit having first and second inputs, said extended pulse being fed to said first input and means for deriving a trigger pulse from the trailing flank of said control signal, said trigger pulse being supplied to said second input, said logic circuit producing an output pulse for switching off the electronic control only if said integrating stage does not produce a said extended pulse during the said trigger pulse.

BRIEF DESCRIPTION OF THE DRAWINGS

A preferred embodiment of the present invention will now be described, by way of example only, with reference to the drawings of which.

DESCRIPTION OF THE PREFERRED EMBODIMENT

Basically, with the system of the present invention the test pulse ($U_{te}$) is extended by an integration stage by a period of time ($t_y$) and the extended pulse ($U_{INTEGR}$) is supplied to a first input of a logic circuit. A trigger pulse ($U_{TRIGGER}$) derived from the disconnection or trailing flank of the control signal ($U_{IN}$) is supplied to a second input of the logic circuit. The logic unit is selected so that an output pulse ($U_{MF}$) initiating disconnection of the electronic control unit only occurs at the logic unit when a pulse is not delivered by the integration stage during the trigger pulse.

In contrast to the circuit arrangement already proposed, in the electronically controlled ignition system in accordance with the invention, the voltage comparator used in the known arrangement is replaced by a logic circuit to which both the trigger pulse and an extended test pulse are supplied. The integration stage now provided includes a capacitor which is substantially smaller than the capacitor of the circuit proposed earlier which was discharged by the test pulses $t_e$) respectively. As a result, it is possible to integrate the capacitors included in the recently proposed circuit completely by integrated circuit techniques into a semi-conductor body, so that there is no longer any need to connect a capacitor externally as would otherwise be necessary.

In the circuit within the electronically controlled ignition system of the present invention, the logic unit preferably comprises a NOR gate, the extended test pulse being applied to its first input as a positive pulse and the negative trigger pulses being applied to its second input. The period by which the test pulse is extended must be longer than the period of the negative trigger pulse.

Figure 1:
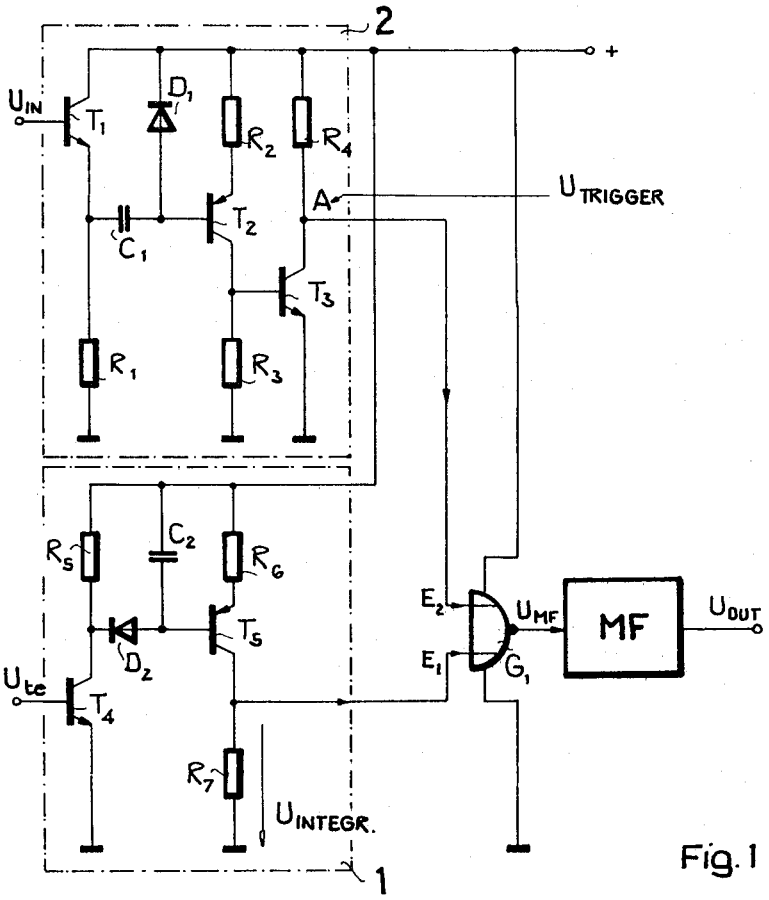
FIG. 1 shows an electronically controlled ignition system having a circuit for detecting misfiring.

Referring now to the drawings, the circuit shown in FIG. 1 comprises an integrator stage 1 and a differentiating stage 2. The output signals of both stages are passed to respective inputs of a NOR GATE $G_1$. The output signal of the NOR gate controls a mono-stable trigger stage MF, the electronic control unit of the ignition system being disconnected thereby when misfiring occurs for a period of time.

Figures 2A, 2B, 2C, 2D, 2E, 2F:
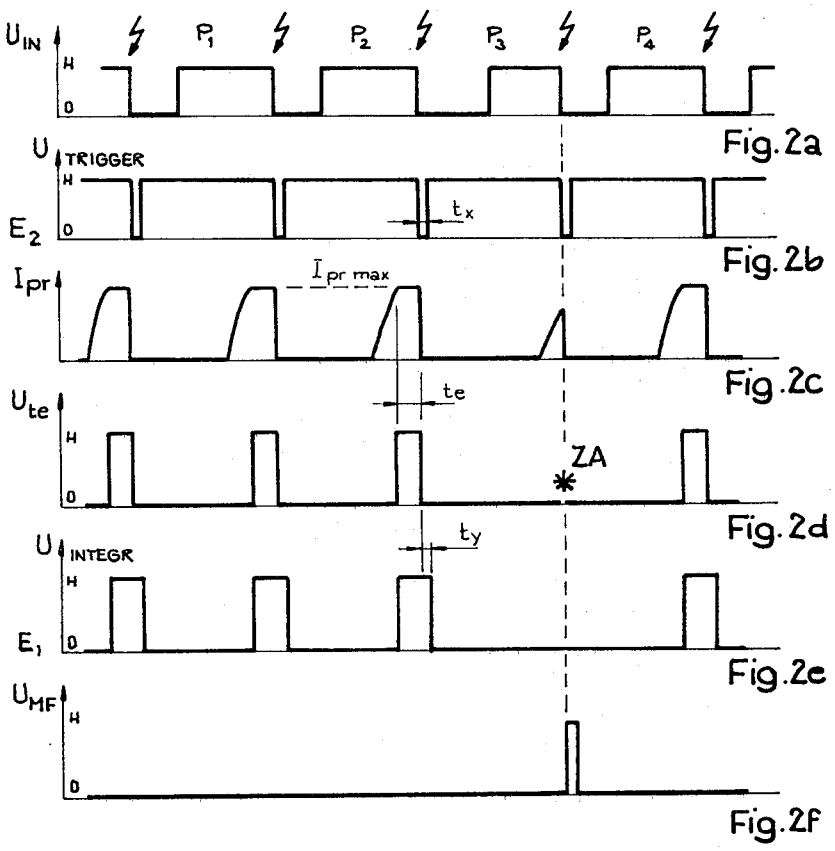
FIGS. 2*a–f* show signals demonstrating the mode of operation of the circuit of FIG. 1.

The integrator stage comprises a transistor $T_4$, the test signal $U_{te}$ being applied to its base electrode, said test signal being obtained according to FIG. 2*d* from the duration of the primary current in the ignition coil at the value $1_{prmax}$ required for ignition. The collector resistor $R_5$ is included in the collector branch of the transistor $T_4$ and the series connection comprising a capacitor $C_2$ and a diode $D_2$ are connected in parallel therewith. The base electrode of the output transistor $T_5$ is connected to the connecting point between the capacitor $C_2$ and diode $D_2$ and the extended test pulse $U_{INTEGR}$ is applied to its collector resistor $R_7$. The emitter resistor $R_6$ of this output transistor $T_5$ is connected to the positive pole of the supply voltage source. The output voltage $U_{INTEGR}$ of the integration stage 1 is passed to the input $E_1$ of the NOR gate $G_1$.

The differentiating stage 2 includes three sequentially connected transistor stages, having the transistors $T_1$, $T_2$ and $T_3$. The control signal $U_{IN}$ which is derived from the ignition pulse generator is passed to the base electrode of the input transistor $T_1$. The emitter collector path of the transistor $T_1$ is by-passed by the differentiating element comprising the capacitor $C_1$ and the diode $D_1$. In addition the transistor $T_1$ has an emitter resistor $R_1$. The base electrode of the transistor $T_2$ is connected to the connection point between the differentiating capacitor $C_1$ and diode $D_1$, the emitter resistor $R_2$ being connected to the positive pole of the supply voltage. The input voltage for the transistor $T_3$ is tapped across collector resistor $R_3$ and the negative trigger pulses $U_{TRIGGER}$ are tapped across its collector and supplied to the input $E_2$ of the NOR gate $G_1$. The collector resistor $R_4$ of the output transistor $T_3$ of the differentiating stage 2 is connected in turn to the positive potential of the supply voltage source. In addition, it can be seen from FIG. 1 that the output connection of the NOR gate $G_1$ is connected to the mono-stable trigger stage MF, the signal $U_{out}$ arising at its output, the electronic control unit of the ignition system being interrupted for a fixed period of time by the said signal $U_{out}$.

In FIG. 2*a* the control signal $U_{IN}$ is shown and is passed to the control electrode of the transistor $T_1$ of the differentiating stage 2. The periods $P_1$ and $P_2$ of the control signal are identical in the example shown, while there is an error caused for example by acceleration in the period $P_3$. The "low phase" of the control signal is extended during this period $P_3$ at the cost of the "high phase". It is assumed that this error no longer occurs during the period $P_4$. The trigger signal $U_{TRIGGER}$ is shown in FIG. 2*b* and occurs at the output A of the differentiating stage and is passed to the input E2 of NOR gate $G_1$. The trigger signal is obtained from the negative flank of the control signal when the control signal passes from the "High Phase" to the "Low Phase". Initially, a pulse is obtained by each flank of control signal $U_{IN}$ across the differentiating element comprising the Capacitor $C_1$ and the diode $D_1$. The trigger pulses emanating from the positive flanks of the control signal $U_{IN}$ are inhibited at the second stage of the differentiating circuit 2 by the transistor $T_2$. Accordingly trigger signals arising from the negative flank of the control signal $U_{IN}$ are present at the collector resistor $R_3$ of the transistor $T_2$. These trigger pulses are inverted at the transistor $T_3$ so that according to FIG. 2*b* trigger pulses are present at the output A of the transistor stage having the transistor $T_3$. The trigger period during which the trigger signal $U_{TRIGGER}$ has its "low value" is designated $t_x$ according to FIG. 2*b*.

The curve of the primary current in the ignition coil is shown in FIG. 2*c*. Up to the point in time of ignition the primary current can rise or have the value $I_{prmax}$ required for ignition. The respective discharge of the ignition coil takes place at the moment of ignition as can be gathered from FIG. 2*c* the primary current reaches its value $I_{prmax}$ (which is required for ignition during normal operation and when using the electronic control unit) at the time $t_e$ before the time of ignition of the respective period. This value is reached during the period $P_1$, $P_2$, and $P_4$. However, it is apparent from FIG. 2*c* that the primary current is not able to achieve the value $I_{prmax}$ required for ignition during the eroneous period $P_3$ so that misfiring ZA occurs.

For the period of time in which the primary current becomes fixed at its maximum in accordance with FIG. 2*c*, a test pulse $U_{te}$ is obtained, its pulse width being predetermined in accordance with FIG. 2*d* by the time $t_e$. Since the primary current in the ignition coil did not reach its value $I_{prmax}$ which is required for ignition during the third period, there was no test pulse $U_{te}$ during the period either.

The test pulse $U_{te}$ is supplied to an integrating amplifier or an integrator stage 1 in accordance with FIG. 1 so that the test pulse is extended as shown in FIG. 2*e* with the aid of the capacitor $C_2$. The period of extension is designated $t_y$. A voltage in accordance with FIG. 2*e* is applied to the output of the integrator stage 1 and its pulses having the pulse width $t_e+t_y$. This signal $U_{INTEGR}$ is supplied to the input $E_1$ of the NOR gate $G_1$. A "high level" only occurs at the output on the NOR gate $G_1$ by definition when both input levels at the inputs $E_1$ and $E_2$ are low. Since the trigger pulses according to FIG. 2*b* are negative pulses always reaching the low level during the trigger time $t_x$, a high level can only occur at the output of the NOR gate $G_1$ when there is no extended test pulse $U_{INTEGR}$ occurring the trigger time $t_x$ within a period of the control signal $U_{IN}$. This is the case with misfiring ZA, so that as shown in FIG. 2*f* an output signal $U_{MF}$ is emitted at the NOR gate $G_1$ at the end of the third period $P_3$, the trigger stage MF being switched by the said output signal $U_{MF}$. For safe operation of the circuit it must be ensured that the extension period $t_y$ of the test pulses is longer than the duration $t_x$ of the trigger signals. For example, $t_y$ is twice as long as $t_x$. In one example the time of 20 μsec was selected for $t_x$ and a time of 40 μsec was selected for $t_y$ by dimensioning the capacitors $C_1$ and $C_2$ accordingly. The capacitors $C_1$ therefore had a value of 30 pF and the capacitor $C_2$ had a value of approximately 60 pF. Capacitors of this size are very easily integrated into integrated semi-conductor circuits so that it is not necessary to provide any special externally connected capacitors. The low values of the capacitances are due in particular to the diodes $D_1$ and $D_2$ which are inserted into the circuit. With the integration stage 1 the capacitor $C_2$ is only charged up via the base current of the transistor $T_5$ and not via the resistor $R_5$ of the parallel RC element so that the capacitance $C_2$ may remain very low. The present invention therefore provides an important improvement and simplification of electronically controlled ignition systems such as that disclosed in German Patent Application No. P 31 11 856.9 which is otherwise highly advantageous.

It will be understood that the above description of the present invention is susceptible to various modifications changes and adaptions.

What is claimed is:

1. An electronically controlled ignition system comprising an ignition coil having a primary winding, means for supplying primary current to said primary winding at a timing which is controlled in accordance with speed, said primary current only reaching the value required for ignition shortly before the moment of ignition, means for determining immediately before the moment of ignition whether said primary current has reached said value required for ignition, said determining means comprising means for deriving a test pulse dependent on the duration for which said primary current is at said value required for ignition, said test pulse switching off the electronic control for a fixed period when there is no primary current or insufficient primary current to prevent misfiring, and an ignition pulse generator producing a control signal the timing of said primary current being derived directly from said control signal, wherein the system further comprises an integrating stage, said integrating stage extending said test pulse by a predetermined period of time to produce an extended pulse, a logic circuit having first and second inputs, said extended pulse being fed to said first input and means for deriving a trigger pulse for the trailing flank of said control signal, said trigger pulse being supplied to said second input, said logic circuit producing an output pulse for switching off the electronic control only if said integrating stage does not produce a said extended pulse during the said trigger pulse.

2. An electronically controlled system as claimed in claim 1 said logic circuit comprising a NOR gate having first and second inputs, said extended pulse being applied to said first input of the NOR gate as a positive pulse, and said trigger pulses being applied to said second input of the NOR gate as a negative pulse and the period by which the test pulse is extended being greater than the duration of said negative trigger pulse.

3. An electronically controlled ignition system as claimed in claim 1, and comprising a differentiating stage with a diode, said trigger pulse being obtained in said differentiating stage by differentiating said control signal produced by the ignition pulse generator and by subsequently inhibiting the pulses formed by the positive leading flanks of said control signal with the aid of said diode.

4. An electronically controlled ignition system as claimed in claim 3, said differentiating and integrating stages comprising capacitors which are integrated in a semi-conductor integrated circuit.

5. An electronically controlled ignition system according to claim 1 said integrating stage comprising first and second transistors, a parallel RC element being arranged in the collector branch of said first transistor, and the base electrode of said second transistor being connected to the collector electrode of said first transistor via a diode, such that the capacitor of said RC element is prevented from charging up via the resistor of the RC element and the capacitor can only charge up via the base current of said second transistor.

* * * * *